US006443246B1

(12) United States Patent
Pessier et al.

(10) Patent No.: US 6,443,246 B1
(45) Date of Patent: Sep. 3, 2002

(54) LONG BARREL INSERTS FOR EARTH-BORING BIT

(75) Inventors: Rudolf Carl Otto Pessier, The Woodlands, TX (US); Brian Christopher Wiesner, Edmond, OK (US); George Edward Dolezal, Friendswood; Matthew Ray Isbell, Houston, both of TX (US); James Lawrence Jacobsen, Shreveport, LA (US); Brian Andrew Baker, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/704,847

(22) Filed: Nov. 2, 2000

(51) Int. Cl.[7] ..... E21B 10/16
(52) U.S. Cl. ..... 175/378; 175/331
(58) Field of Search ..... 175/374, 426, 175/378, 331

(56) References Cited

U.S. PATENT DOCUMENTS

| | | | | |
|---|---|---|---|---|
| 4,056,153 A | | 11/1977 | Migliorini | 175/376 |
| 4,067,406 A | * | 1/1978 | Garner et al. | 175/341 |
| 4,940,099 A | * | 7/1990 | Deane et al. | 175/374 |
| 4,984,643 A | | 1/1991 | Isbell et al. | 175/341 |
| 5,323,865 A | | 6/1994 | Isbell et al. | 175/378 |
| 5,351,768 A | | 10/1994 | Scott et al. | 175/374 |
| 5,697,462 A | | 12/1997 | Grimes et al. | 175/374 |
| 5,819,861 A | | 10/1998 | Scott et al. | 175/371 |

FOREIGN PATENT DOCUMENTS

| | | |
|---|---|---|
| EP | 0593268 A2 | 4/1994 |
| GB | 2281330 A | 3/1995 |
| GB | 2314870 A | 1/1998 |

OTHER PUBLICATIONS

Hughes Christensen Article "HydraBoss" Hydraulically Enhanced Drill Bits, 7 pgs, 1997.

* cited by examiner

*Primary Examiner*—David Bagnell
*Assistant Examiner*—Zakiya Walker
(74) *Attorney, Agent, or Firm*—Bracewell & Patterson, L.L.P.

(57) ABSTRACT

An earth-boring bit for attachment to a drill string has rotatable cones with rows of cutting elements. The cutting elements are arranged in generally circumferential rows on each of the cones and interference fit into apertures in the shell surface. The rows include a heel row of cutting elements on the heel surface of each of the cones, and an adjacent row of adjacent row cutting elements next to the heel row cutting elements. Each heel row cutting element has at least one counterpart adjacent row cutting element that is spaced no farther from it than any other adjacent row cutting element, defining a proximal pair. Each of the cutting elements in each of the proximal pairs has a grip ratio, which is the barrel length divided by the diameter. Some of the proximal pairs having cutting elements with higher grip ratios than other cutting elements. None of the proximal pairs has both cutting elements with higher grip ratios.

23 Claims, 5 Drawing Sheets

LONG BARREL INSERTS FOR EARTH-BORING BIT

BACKGROUND OF THE INVENTION

1. Field of the Invention

The present invention generally relates to earth boring drill bits used in the oil, gas and mining industries. More particularly, the present invention relates to tungsten carbide cutting elements having different lengths of insertion into supporting metal of a rotating cone drill bit.

2. Background Information

The success of rotary drilling enabled the discovery of deep oil and gas reservoirs. The rotary rock bit was an important invention that made rotary drilling economical. Only soft earthen formations could be commercially penetrated with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, in the early 1900's, could drill a scant fraction of the depth and speed of the modern rotary rock bit. The original Hughes bit drilled for hours; the modem bit drills for days. Modem bits sometimes drill for thousands of feet instead of the mere few feet early bits drilled. Many advances have contributed to the impressive improvement of rotary rock bits.

In drilling boreholes in earthen formations by the rotary method, rock bits fitted with one, two, or three rolling cones or cutters are employed. The bit is secured to the lower end of a drillstring that is rotated from the surface or by downhole motors or turbines. The cones mounted on the bit roll and slide upon the bottom of the borehole as the drillstring is rotated, thereby engaging and disintegrating the formation material to be removed. The cones are provided with teeth or inserts that are forced to penetrate and gouge the bottom of the borehole by weight from the drillstring. The cuttings from the bottom and sidewalls of the borehole are carried to the surface in suspension by drilling fluid that is pumped down from the surface through the hollow, rotating drillstring. Certain aspects in the design of the rolling cones becomes particularly important if the bit is to penetrate deep into hard, high compressive strength, tough, and abrasive formation materials, such as limestones, dolomites and sandstones.

Because of the strength of these materials, insert penetration is reduced, and rock ribs form between the shallow craters generated by the inserts. Rock ribs formed in the high compressive strength, abrasive formation materials can become quite strong, causing the cone to ride up on the ribs and robbing the inserts of unit load necessary to accomplish effective penetration and crushing of formation material.

In hard and abrasive formations, the wear on the inserts, especially the heel inserts and the matrix holding them, is so severe that the inserts may eventually become dislodged from the cones, resulting in ring-outs on the gage. A loss of heel inserts leads to a ring-out on the gage because the gage inserts are forced to bear the entire burden of maintaining a minimum borehole diameter or gage, and the gage inserts cannot sustain this burden for long periods of drilling. This occurrence generates undesirable increases in lateral forces and torque on the cones, which lowers penetration rates and accelerates wear on the cone bearing and subsequent bit failure. The provision of cones with more closely spaced inserts reduces the size of rock ribs and the unit load on each individual insert, but it slows the rate of penetration and does not fundamentally change the wear characteristics at the tungsten carbide inserts and the steel matrix holding them.

Prior art earth-boring bits follow the conventional design rules, which use insert diameter to barrel length ratios, "grip ratios," in the 0.75 to 1.00 range to determine insert embedment. The limit for the barrel length of a cutting element is the minimum section of steel between adjacent inserts. The harder formation bits aim for maximum insert count with minimum section and therefore low grip ratios. In at least one instance in the past, grip ratios in the range from about 1.0 to 1.1 were used on inner rows of soft formation bits, having scoop-shaped inserts.

SUMMARY OF THE INVENTION

The bit body of the present invention has at least one cantilevered bearing shaft depending inwardly and downwardly from the bit body. A cone is mounted for rotation on the bearing shaft and includes a plurality of cutting elements arranged in generally circumferential rows on the cone. The rows of cutting elements include at least one heel row, at least one inner row, and at least one gage row. The cutting elements are formed of hard metal and are interference fit into apertures in the cone.

In one aspect of the invention, each heel row cutting element has at least one counterpart adjacent row cutting element that is spaced no farther from said heel row cutting element than any other adjacent row cutting element. The two neighboring cutting elements may be considered a proximal pair, although they are normally different in size and shape. Also, each heel row cutting element may be paired with more than one adjacent row cutting element, because normally there will be two adjacent row cutting elements spaced the same distance from each heel row cutting element. One of the cutting elements within some of the proximal pairs has a longer barrel length and greater grip ratio than the other cutting element within the same proximal pair. However, none of the proximal pairs has two cutting elements with the longer barrel lengths. This assures a minimum section of supporting metal in the cone body between the cutting elements.

In another aspect of the invention, one of the heel rows has cutting elements with more than one grip ratio that alternate with each other in a selected pattern. In a first pattern, a greater grip ratio cutting element alternates with a lesser grip ratio cutting element. The adjacent row will have lesser grip ratios. This arrangement is utilized on the cone that has a greater density in the heel row than the other cones. The other cones of this embodiment may have all greater grip ratio heel row cutting elements and all lesser grip ratio adjacent row cutting elements.

In another embodiment, the pattern for all of the cones comprises two lesser grip ratio cutting elements separated by one greater grip ratio cutting element. This is employed in both the heel and adjacent rows. A third embodiment employs heel row cutting elements with standard grip ratios. The adjacent cutting elements, however, will be of greater grip ratios, or alternating with greater and lesser grip ratios.

DESCRIPTION OF THE PREFERRED EMBODIMENT

Figure 1:
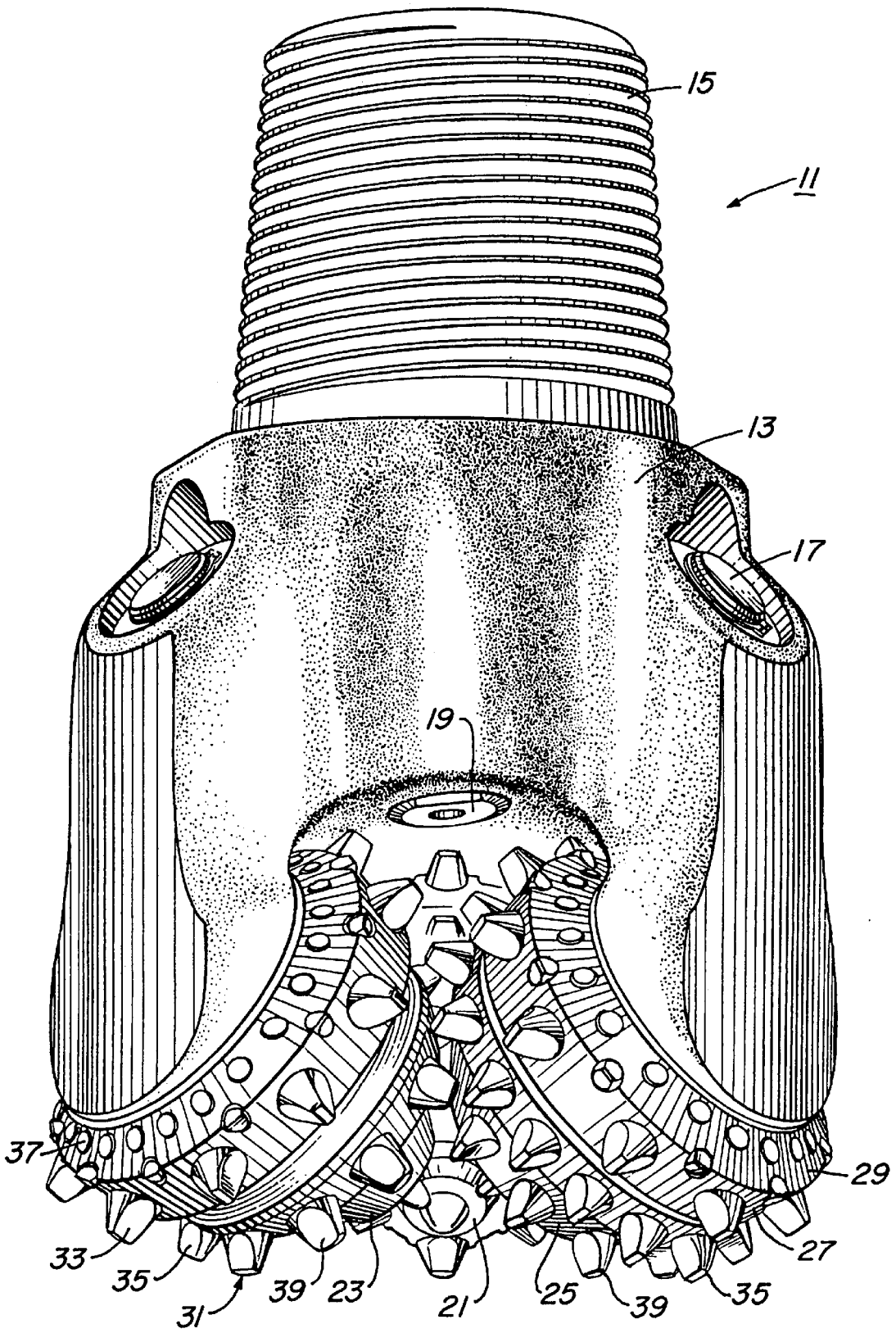
FIG. 1 is a perspective view of an earth-boring bit according to prior art.

The numeral 11 in FIG. 1 of the drawing designates an earth-boring bit 11 having three rotatable cones, each having wear resistant cutting elements used as earth disintegrating teeth. Bit 11 includes a bit body 13, which is threaded at its upper extent 15 to be secured to a drillstring member (not shown). The drillstring member (not shown) is used to raise and lower the bit 11 into the wellbore and to rotate the bit 11 during drilling. Each leg of bit 11 can be provided with a lubricant compensator 17, a preferred embodiment of which is disclosed in U.S. Pat. No. 4,276,946, Jul. 7, 1981, to Millsapps. A plurality of nozzles 19 are carried by bit body 13 to discharge pressurized drilling fluid from the drillstring (not shown) onto the bottom of the borehole to cool and lubricate bit 11 and to remove cuttings as formation material is disintegrated.

A plurality of cones 21, 23 and 25, in this case three, are mounted for rotation onto cantilevered bearing shafts (obscured from view in FIG. 1) extending inwardly and downwardly from each leg of bit body 13. A heel surface 27 is defined on each cone 21, 23 and 25 just inward and adjacent an outermost or gage surface 29.

Figure 2:
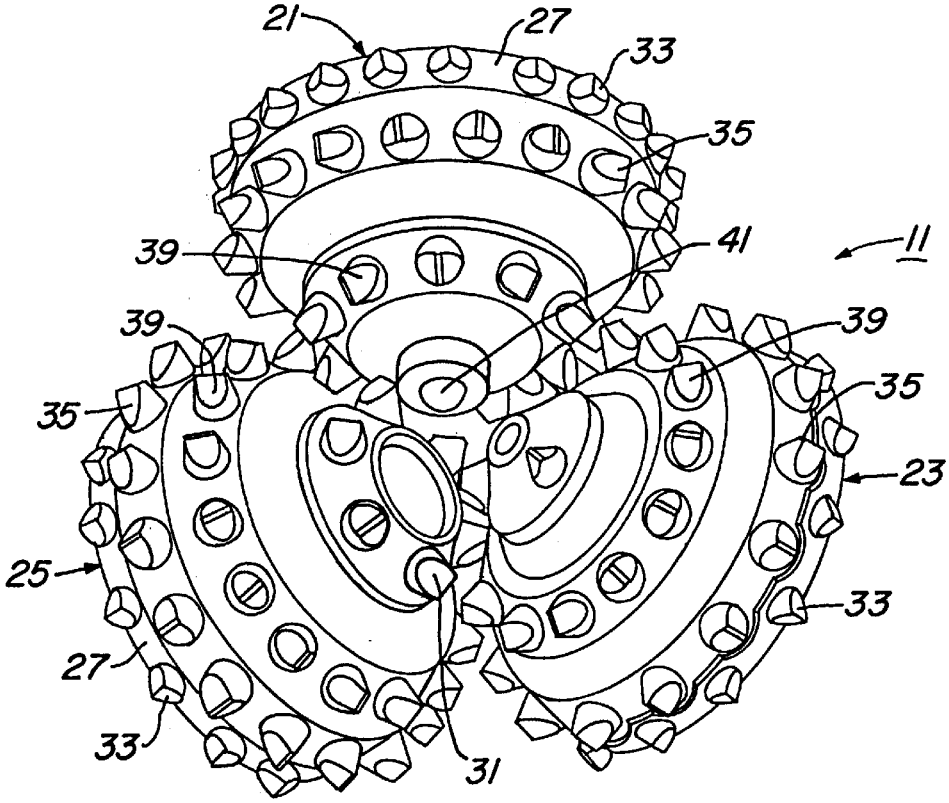
FIG. 2 is a perspective view, viewed from below looking upwardly, of the cones of an earth-boring bit constructed in accordance with this invention.

Referring also to FIG. 2, each cone 21, 23 and 25 includes a plurality of cutting elements 31 arranged in generally circumferential rows on the frusto-conical cones. Each cutting element 31 within a particular row will be at the same distance from the axis of rotation of bit 11 as the others within the same row. Cutting elements 31 are formed by press-fitting or otherwise securing inserts into sockets or apertures 43 (FIG. 3) drilled into the surfaces of cones 21, 23 and 25. Cutting elements are made of a variety of hard, abrasion-resistant materials, including, but not limited to, tungsten carbide. Cutting elements 31 are illustrated as being primarily chisel-shaped inserts, but could also be ovoid-shaped, ogive-shaped, or any other conventional shape.

Cutting elements 31 include heel row cutting elements 33 secured to heel surface 27 of each cone 21, 23 and 25. An adjacent row of cutting elements 35 is located next to heel row cutting elements 33 and radially inward from the bit axis of rotation. Gage inserts 37 are secured to gage surface 29 for engaging the sidewall of the borehole in drilling operations. One or more inner rows 39 are located on each cone 21, 23, 25, radially inward from adjacent row 35. The cone often referred to as "cone number 1" has a nose cutting element 41.

Figure 3:
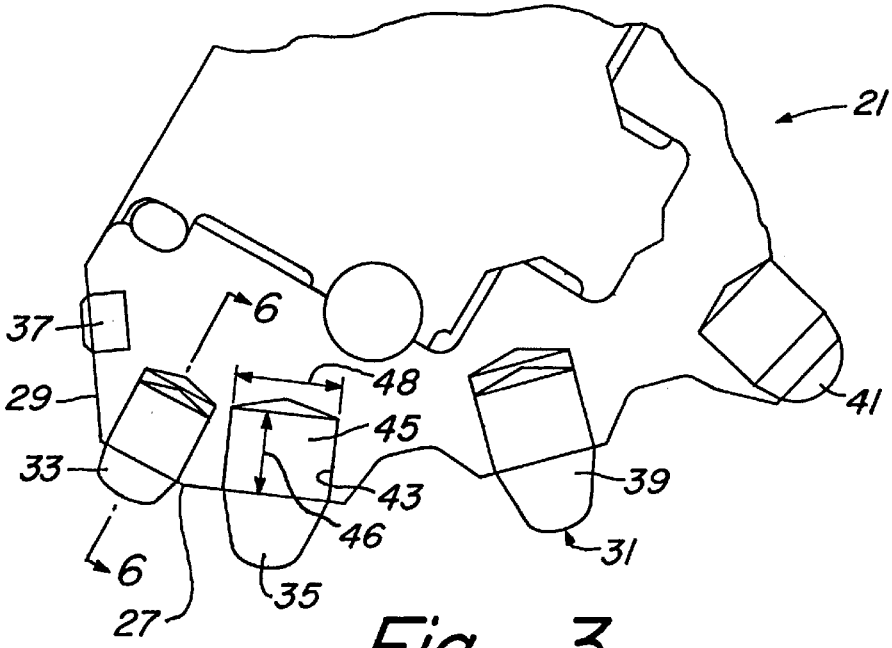
FIGS. 3 through 5 are fragmentary, longitudinal sectional views of the three cones of the earth-boring bit of FIG. 2.
Figure 4:
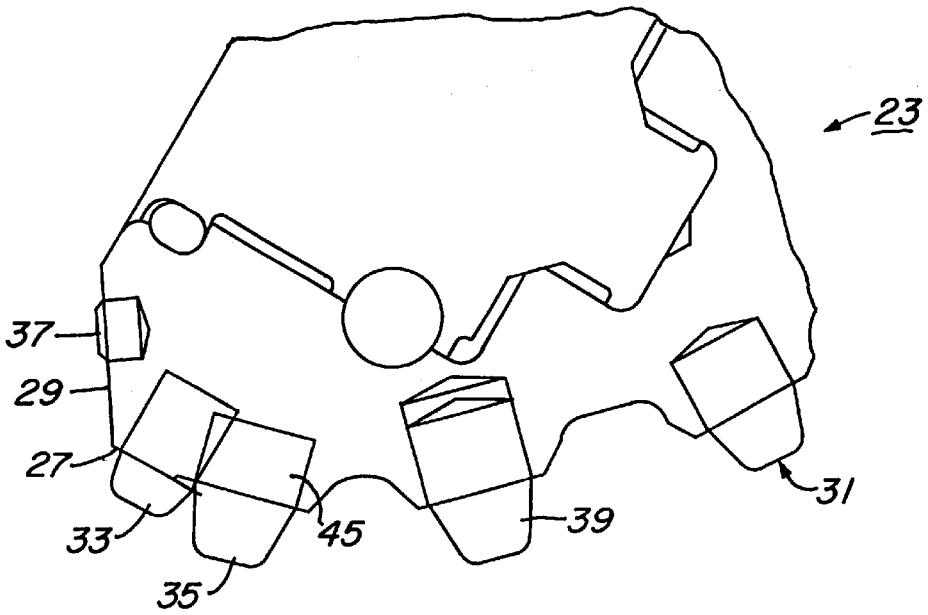
Figure 5:
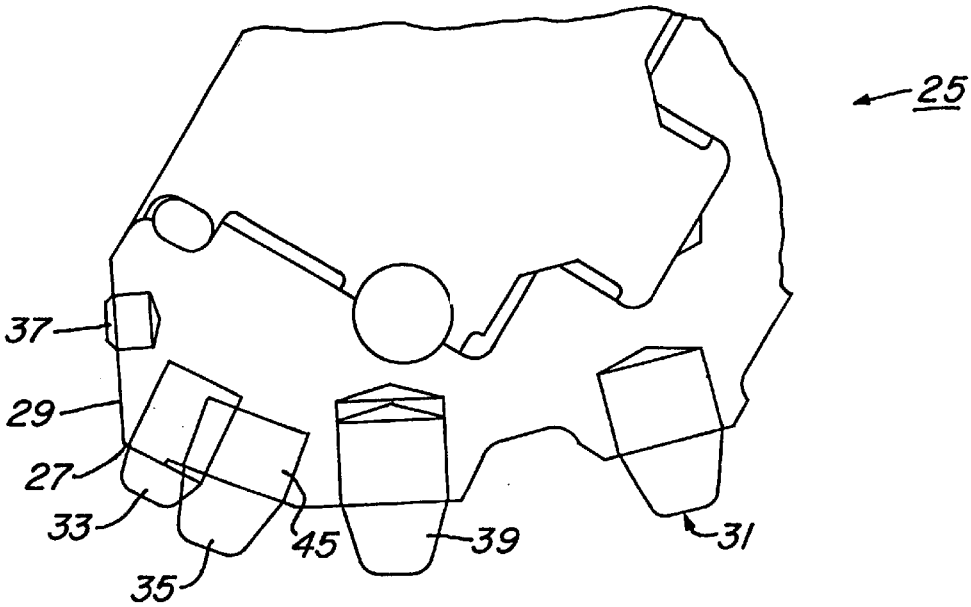

FIGS. 3–5 are enlarged, fragmentary section views of the cones 21, 23 and 25 of the earth-boring bit 11 of FIGS. 1 and 2. The figures schematically depict the superimposition of the cutting elements 31 of the cones 21, 23 and 25 to illustrate the cutting profile of bit 11 with respect to the bottom and sidewall of the borehole (not shown). Heel row cutting elements 33 are positioned on heel surface 27 to kerf the outermost portion of the bottom of the borehole plus the sidewall and corner of the borehole. If chisel-shaped, heel cutting elements 33 may be arranged as either axial cutting elements or circumferential cutting elements. Axial cutting elements are so named because their crests are aligned with the axis of rotation of each cone. Circumferential cutting elements are so named because their crests are oriented circumferentially or transversely to the axis of rotation of each cone.

As shown in FIG. 2, cone 21 has more heel row cutting elements 33 than the other cones 23, 25. In one embodiment, it has twenty heel row inserts 33 while the other two cones 23, 25 have fourteen or less, thus it is a more dense row. Referring to FIG. 3, the reason has to do with the requirement of adequate supporting metal surrounding each hole 43 . Each cutting element 31 has a cylindrical barrel portion 45 that fits within hole 43 with an interference fit. The supporting metal must be adequate to support barrel 45 within each hole 43, thus there is a limit to the spacing of cutting elements 31 within a row and to the cutting elements 31 of the nearby row. The adjacent row cutting elements 35 in cone 21 are spaced farther from the heel row cutting elements 33 than in cones 23, 25, allowing a greater density for heel row cutting elements 33 in cone 21 than the heel row cutting elements of cones 23, 25. In cones 23, 25 of the bit of this embodiment, heel row cutting elements 33 "intermesh" with the adjacent row cutting elements 35. As can be seen by comparing FIGS. 4 and 5 with FIG. 3, the adjacent row cutting elements 35 are spaced such that an outer portion of each cutting element barrel 45 is spaced farther from the bit axis of rotation than an inner portion of the barrel 45 of each heel row cutting element 33. Consequently, when superimposed on their paths of rotation about the cone axis as shown in FIGS. 4 and 5, some overlap between heel row cutting elements 33 and adjacent row cutting elements 35 can be observed. In FIG. 3, there is no overlap between the adjacent row cutting elements 35 and the heel row cutting elements 33. Because of the intermeshing, there are fewer heel row cutting elements 33 on cones 23, 25 than on cone 21.

Earth-boring bits for harder earth formations require a larger number of cutting elements 31, resulting in a minimum section of supporting steel between them. These bits have low grip ratios. The grip ratio of each cutting element 31 is considered to be the barrel length 46 divided by the barrel diameter 48 (FIG. 3). Tests revealed that the greatest wear and earliest loss of cutting elements occurs in the heel rows 33 and adjacent rows 35. Generally, a greater grip ratio would increase retention, however, it reduces the amount of supporting metal between holes 45 because the axes of holes 45 are not parallel. Without adequate supporting metal, a greater grip ratio would not help retain a cutting element 31.

Figure 7:
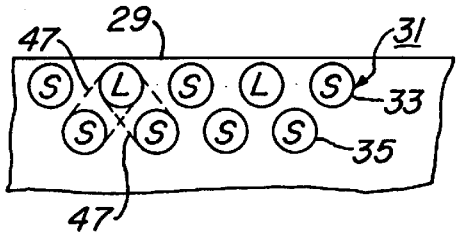
FIGS. 7–8 are schematic representations of the heel row and adjacent row of the first cone and the second and third cones, respectively, of the embodiment of FIGS. 1–6.

In this invention, greater and lesser grip ratios are used for cutting elements 31 in close proximity to each other to avoid reducing supporting metal excessively, yet increase retention. FIG. 7 shows schematically a few heel row cutting elements 33 and adjacent row cutting elements 35 for a first embodiment. Each heel row cutting element 33 is located a minimum distance from at least one of the adjacent row cutting elements 35. In this embodiment, each heel row cutting element 33 is located equidistant from two of the adjacent row cutting elements 35 because the rows are staggered or offset from each other. The dotted lines are referred to herein as a proximal pair. That term means the grouping of one heel row cutting element 33 with an adjacent row cutting element 35 that is no farther from the heel row cutting element 33 than any other adjacent row cutting elements 35.

Figure 6:
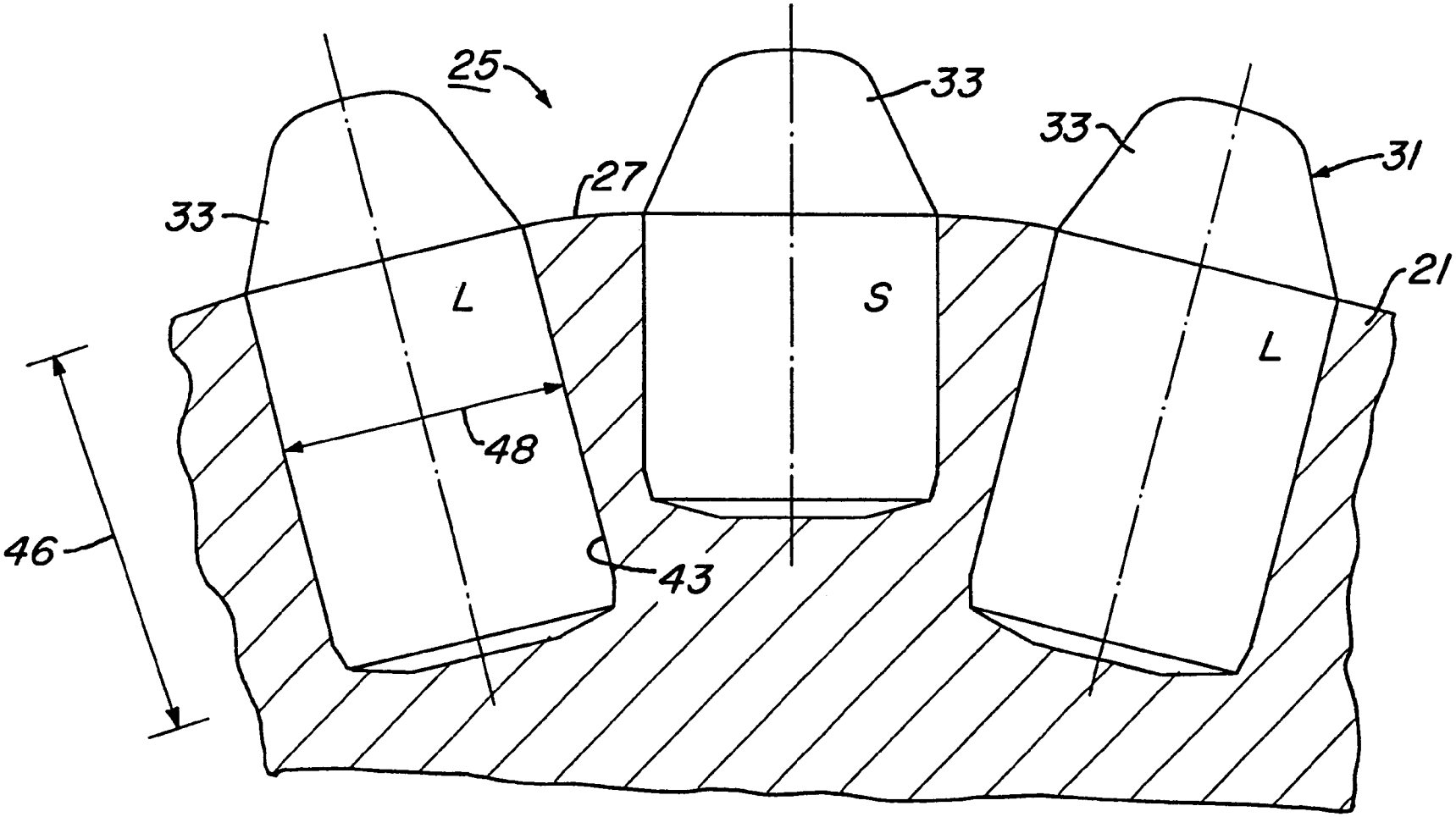
FIG. 6 is a sectional view of the cone of FIG. 3, taken along the line 6—6 of FIG. 3.

In the first embodiment, for heel row cutting elements 33, higher grip ratios, indicated as "L" for longer lengths of barrel 45 (FIG. 3), are alternated with lesser grip ratios, indicated as "S" for shorter lengths of barrel 45. Each higher grip ratio L is followed by a lesser grip ratio S. FIG. 6 illustrates how this pattern avoids decreasing supporting metal between heel row cutting elements 33. The diameters 48 of the L and S cutting elements 33 are the same, however barrel lengths 46 of the L cutting elements are longer. If the L cutting elements 33 instead had the same barrel length 46 as the S cutting element, the section of metal between their retention holes 43 would be the same as in the embodiment of FIG. 6. If all three of the cutting elements 33 were L cutting elements, the retention holes 43 would intersect each other, which is not workable.

So as to avoid spacing an L cutting element 33 in a proximal pair 47 with an adjacent row cutting element 35 of longer barrel length, all of the adjacent row cutting elements 35 of this embodiment have shorter lengths and thus lesser grip ratios than the heel row cutting elements 33. No proximal pair 47 has two longer barrel cutting elements 31, although some of the proximal pairs 47 in FIG. 7 have two shorter barrel cutting elements 31. In FIG. 3, the double lines for the bottom of hole 43 for heel row cutting elements 33 indicate the alternating grip ratios of FIG. 7. Note that preferably nose cutting element 41 has an increased barrel length, and the next inner row has cutting elements 39 that alternate in grip ratios with one another, with a higher grip ratio following each lower grip ratio.

Figure 8:
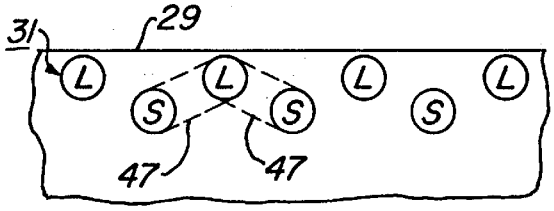

FIG. 8 show the preferred grip ratios for heel row cutting elements 33 and adjacent row cutting elements 35 for cones 21, 23. All of the heel row cutting elements 33 are of longer barrel lengths, and all of the adjacent row cutting elements are of shorter barrel lengths. All proximal pairs 47 have one longer L cutting element and one shorter S cutting element. FIG. 4 illustrates cone 23 while FIG. 5 shows cone 25. Preferably each cone 23, 25 has an inner row with cutting elements 39 having alternating grip ratios in the same manner as the inner row cutting elements 39 of cone 21.

The S cutting elements 31 with shorter barrel lengths 46 have grip ratios no greater than 1.0 and preferably no greater than 0.7. The grip ratios of the L cutting elements with longer barrel lengths 46 at least equal to 1.0 and preferably in the range from 1.2 to 1.5. Also, it is preferred to have grip ratios for the L cutting elements at least 50 percent higher than the grip ratios for the S cutting elements. The diameters of these longer barrel length cutting elements 31 are conventional and the same as the diameters of the shorter barrel cutting elements 31 in the same row.

Figure 9:
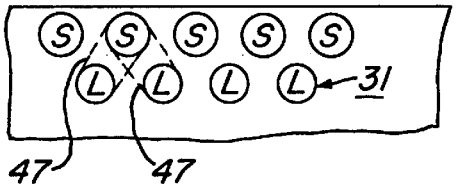
FIGS. 9–10 are schematic representations of the heel row and adjacent row of the first cone and the second and third cones, respectively, of a second embodiment.
Figure 10:
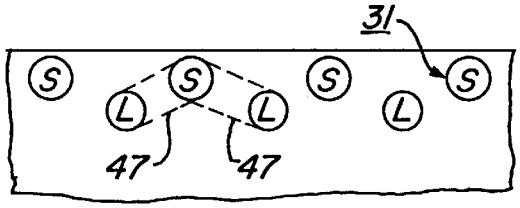

Referring to FIGS. 9 and 10, in this embodiment, each proximal pair 47 also avoids having two L cutting elements. Each heel row cutting element 33 is of a conventional length and conventional grip ratio. Each adjacent row cutting element 35 is of a longer length and higher grip ratio. If the spacing happened to be too close, the adjacent row cutting elements 35 could alternate with short and long lengths in the same manner as heel row cutting elements 33 of the first embodiment of FIG. 7.

Figure 11:
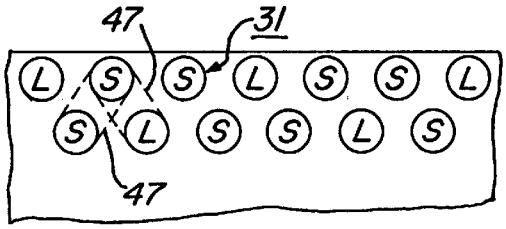
FIGS. 11–12 are schematic representations of the heel row and adjacent row of the first cone and the second and third cones, respectively, of a third embodiment.
Figure 12:
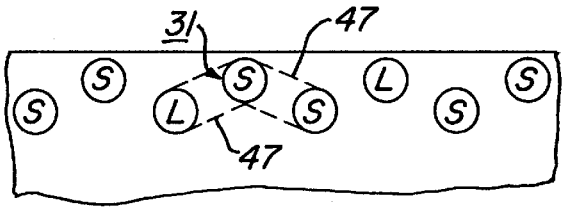

In a third embodiment shown in FIGS. 11 and 12, both heel row cutting elements 33 and adjacent row cutting elements 35 for all cones 21, 23, 25 have a different alternating pattern. Two S cutting elements are followed by a single L cutting element. This avoids having any proximal pair 47 with two high grip ratio L cutting elements 31. Some of the proximal pairs 47 will have two S cutting elements with conventional barrel lengths and grip ratios. Other proximal pairs 47 will have one L cutting element with a longer barrel length and one S cutting element with a shorter barrel length. The second and third embodiments may also have one or more rows of inner row cutting elements with alternating grip ratios similar to inner row cutting elements 39 of FIGS. 3–5.

Referring to FIG. 1, in operation of the drill bit 11, the bit 11 is attached to a drill string (not shown), enabling the bit 11 to be raised and lowered, as well as rotated from the surface of the earth. Weight is applied to bit 11 during rotation such that the cones 21, 23 and 25 rotate and cause the cutting elements to engage and disintegrate the bottom of the borehole. Each circumferential row of cutting elements engages a designated annular pattern on the bottom of the borehole.

The earth-boring bit according to the present invention has a number of advantages. The principle advantage of the present embodiment is that earth-boring drill bits will have a prolonged drilling life since at least some of the cutting elements will resist detachment from the rolling cones longer than bits according to conventional design rules. With the longer drilling life comes increased and more efficient production rates and decreased drilling costs. This advantage provides a more consistent borehole diameter, and permits high penetration rates over the life of the bit.

The invention has been described with reference to preferred embodiments thereof. Those skilled in the art will appreciate that the present invention is susceptible to variation and modification without departing from the scope and spirit thereof.

What is claimed is:

1. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, the heel row cutting elements having cutting ends located at a gage diameter of the bit, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and at least some of the heel row cutting elements on at least one of the cones having barrel lengths that are greater than barrel lengths of the adjacent row cutting elements on the same cone.

2. The earth-boring bit according to claim 1, wherein the heel row cutting element of at least some of the proximal pairs has the higher grip ratio.

3. The earth-boring bit according to claim 1, wherein the barrel lengths of all of the heel row cutting elements on two of the cones are greater than the barrel lengths of the adjacent row cutting elements on the same cones.

4. An earth-boring bit adapted for attachment to a drill string, comprising:

a bit body;

plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein the adjacent row cutting element of at least some of the proximal pairs has the higher grip ratio.

5. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein the lower grip ratio is no greater than 1.0, and higher grip ratio is at least equal to 1.0.

6. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein the higher grip ratio is at least 50 percent greater than the lower grip ratio.

7. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein in a first cone, the heel row cutting elements are spaced closer to each other than in the other cones, some of the heel row cutting elements of the first cone having the higher grip ratio and alternating with others of the cutting elements having the lower grip ratio in a selected pattern.

8. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio;

and wherein:

in a first one of the cones, the heel row cutting elements are spaced closer to each other than in the other cones, the heel row cutting elements of the first cone having higher and lower grip ratios that alternate with one another; and in the other cones, the heel row cutting elements have the higher grip ratios and the adjacent row cutting elements having the lower grip ratios.

9. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein in at least one the cones, the heel and adjacent rows each have a pattern of two cutting elements with the lower grip ratio separated by one cutting element with the higher grip ratio.

10. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein at least some of the heel row cutting elements on one of the cones have the higher grip ratio and at least some of the heel row cutting elements on the other cones have the lower grip ratio.

11. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface;

plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements;

each of the heel row cutting elements having at least one counterpart of the adjacent row cutting elements that is spaced no farther from said heel row cutting element than any other of the adjacent row cutting elements, defining a proximal pair;

one of the cutting elements within at least some of the proximal pairs having a higher grip ratio, and the other of the cutting elements within the same proximal pair having a lower grip ratio that is less than the higher grip ratio;

none of the proximal pairs having both of the cutting elements with the higher grip ratio; and wherein the heel row on at least one of the cones has a greater density of cutting elements than the heel rows on the other cones, at least some of the cutting elements of the more dense heel row having the lower grip ratio and at least some of the heel row cutting elements of the other of the cones having the higher grip ratio.

12. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface; and a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements, the cutting elements in at least one of the rows in at least one of the cones having more than a single grip ratio.

13. The earth-boring bit according to claim 12, wherein the heel row of a first one of the cones has a greater density than the heel rows of the other cones, and has cutting elements with two different grip ratios that alternate in a selected pattern.

14. The earth-boring bit according to claim 12, wherein:

in a first one of the cones, the heel row cutting elements are spaced closer to each other than the heel row cutting elements of the other cones, the heel row cutting elements of the first cone having two different grip ratios that alternate with one another; and in the other cones, the heel row cutting elements have greater grip ratios than the cutting elements of the adjacent row.

15. The earth-boring bit according to claim 12, wherein in at least one the cones, the heel and adjacent rows each have a pattern of two cutting elements with a lesser grip ratio separated by one cutting element with a greater grip ratio, the patterns being offset relative to one another so as to avoid any of the heel row cutting elements with the greater grip ratio being located closer to an adjacent row cutting element with the greater grip ratio than to an adjacent row cutting element with the lesser grip ratio.

16. The earth-boring bit according to claim 12, wherein the heel row and the adjacent row define a pattern in each cone wherein each heel row cutting element has at least one counterpart adjacent row cutting element that is spaced no farther from said heel row cutting element than any other adjacent row cutting element, defining a proximal pair, the cutting elements within some of the proximal pairs having a greater grip ratio that the other within the same proximal pair, but none of the proximal pairs of any of the cones having both cutting elements with greater grip ratios than other cutting elements within the same heel row and adjacent row.

17. The earth-boring bit according to claim 12, wherein at least one of the cones has an inner row of cutting elements having more than one grip ratio.

18. The earth-boring bit according to claim 12, wherein:

at least some of the adjacent row cutting elements of each of the cones have greater grip ratios than the heel row cuttings elements in the same cone.

19. The earth-boring bit according to claim 12, wherein some of said cutting elements in said at least one of the rows in at least one of the cones have grip ratios at least equal to 1.0 and others of the cutting elements within the same row have grip ratios less than 1.0.

20. An earth-boring bit adapted for attachment to a drill string, comprising:

a bit body;

a plurality of cantilevered bearing shafts depending inwardly and downwardly from the bit body;

a rolling cone rotatably secured to each of the bearing shafts, each of the cones having a shell surface including at least a gage surface intersecting a heel surface; and a plurality of cutting elements press-fit into apertures arranged in generally circumferential rows on each of the cones, the rows in each of the cones including at least one heel row of heel row cutting elements on the heel surface, and an adjacent row of adjacent row cutting elements next to the heel row cutting elements, and the heel row cutting elements of at least one of the cones having more than one grip ratio and alternating with one another in a selected pattern.

21. The earth-boring bit according to claim 20, wherein the selected pattern comprises alternating one of the heel row cutting elements with a greater grip ratio with another of a lesser grip ratio.

22. The earth-boring bit according to claim 20, wherein the selected pattern comprises alternating two heel row cutting elements with lesser grip ratios with one of having a greater grip ratio.

23. The earth-boring bit according to claim 20, wherein:

a first one of the cones has a greater density of the heel row cutting elements than the heel row cutting elements of the other of the cones;

the heel row of the first one of the cones alternating one of the heel row cutting elements with a greater grip ratio with another of lesser grip ratio;

the adjacent row cutting elements of the first one of the cones having lesser grip ratios than the grip ratio of the heel row cutting elements; and the other of the cones having greater grip ratios in the heel row cutting elements than in the adjacent row cutting elements.

* * * * *

UNITED STATES PATENT AND TRADEMARK OFFICE

CERTIFICATE OF CORRECTION

PATENT NO. : 6,443,246 B1
DATED : September 3, 2002
INVENTOR(S) : Rudolf Carl Otto Pessier et al.

It is certified that error appears in the above-identified patent and that said Letters Patent is hereby corrected as shown below:

Column 1,
Line 21, delete “modem” and insert -- modern --
Line 22, delete “Modem” and insert -- Modern --

Column 4,
Line 42, after “46” insert -- are --

Column 6,
Line 15, delete “principle” and insert -- principal --

Signed and Sealed this

Eleventh Day of February, 2003

JAMES E. ROGAN
*Director of the United States Patent and Trademark Office*